United States Patent [19]

Louvel

[11] Patent Number: 4,534,313

[45] Date of Patent: Aug. 13, 1985

[54] MARKING APPARATUS

[75] Inventor: Robin Louvel, Cornwall, England

[73] Assignee: Bowthorpe-Hellermann Limited, West Sussex, England

[21] Appl. No.: 529,128

[22] Filed: Sep. 2, 1983

[30] Foreign Application Priority Data

Sep. 2, 1982 [GB] United Kingdom ..... 8225055

[51] Int. Cl.[3] ..... B05C 1/02

[52] U.S. Cl. ..... 118/696; 118/41; 118/44; 118/242; 346/76 L; 346/140 R

[58] Field of Search ..... 346/76 L, 140 R; 118/697, 698, 40, 641, 41, 242, 44, 696

[56] References Cited

U.S. PATENT DOCUMENTS 2,366,187 1/1945 Friedwald ..... 118/40 X
3,474,755 10/1969 Voo ..... 118/44
3,543,279 11/1970 Rempel et al. ..... 346/141
3,803,637 4/1974 Martin ..... 346/76 L
3,943,527 3/1976 Hartmann ..... 118/410 X
4,029,006 6/1977 Mercer ..... 118/630 X

*Primary Examiner*—John P. McIntosh
*Attorney, Agent, or Firm*—Watson, Cole, Grindle & Watson

[57] ABSTRACT

A marking apparatus for providing individual marker sleeves for cables is arranged to receive tubing and transport it lengthwise of itself past a marking head of the apparatus, the marking head being responsive to command signals supplied to it from a character generation unit to mark the tubing with required indicia or characters. Downstream of the marking head, a cutting mechanism is provided for severing or semi-severing the tubing according to the required individual marker sleeves.

13 Claims, 6 Drawing Figures

MARKING APPARATUS

BACKGROUND OF THE INVENTION

The present invention relates to a marking apparatus, and in particular to a marking apparatus which can provide indicia on sleeves intended as markers for cables. The invention also relates to the sleeves when marked by such apparatus.

Markers are often used on electrical cables for identification purposes and conveniently may comprise a plastic sleeve, which has been marked with the identifying indicia, the plastic sleeve being then slipped over the cable or wire to be marked.

U.S. Pat. No. 4,029,006 discloses an apparatus for printing indicia on a continuous elongate three-dimensional member but it does not provide for marking plastic tubing and severing or semi-severing the marked product downstream of the marking head, i.e., to provide individual marker sleeves.

I have now devised an apparatus for rapidly and automatically providing marker sleeves bearing indicia meeting individual requirements. This particularly enables a rapid service to be provided to those who apply markers to cables, in that an order for specified sleeves with specified indicia can quickly be converted to machine instructions to which the apparatus automatically responds for marking sleeves according to the requirements so that the order can be quickly fulfilled.

SUMMARY OF THE INVENTION

Thus, in accordance with this invention there is provided a marking apparatus comprising means for receiving tubing and transporting it lengthwise of itself past a marking head of the apparatus, the marking head being responsive to command signals supplied thereto to mark the tubing with required indicia, and means downstream of the marking head to sever or semi-sever the tubing along transverse lines defining individual marker sleeves. The semi-severing is such that the individual sleeves may be separated by subsequently tearing the remaining unsevered portion of tubing.

A preferred feature of the apparatus is that the tubing is temporarily flattened transversely thereof at the location of the marking head to present an area of maximum width to a marking pen or the like instrument of the marking head. This enables an improved quality of the characters as marked, i.e., relative to the arrangement of U.S. Pat. No. 4,029,006.

A further preferred feature is that the marking pen or like instrument of the marking head is physically moved in accordance with the received command signals to trace out (i.e. write) the required indicia on the tubing, using a quick-drying ink. This is a simplification relative to the ink jet printer of U.S. Pat. No. 4,029,006, wherein ink drops are electrostatically deflected according to a raster. Thus, the pen may be mounted for movement along mutually perpendicular X,Y and Z axes in accordance with its command instructions, the Z-axis being used for lift and positioning purposes and the tubing being stationary at the instant of writing each index mark and then stepped forward before the next index mark is applied. Alternatively the pen may be mounted for movement along only the Y-axis (transverse to the tubing) in addition to the Z axis, the X-axis relative movement being achieved by lengthwise movement of the tubing (forwards and backwards according to the appropriate X-axis command signals being supplied to the tubing transporting means). In place of the pen, the marking may be carried out by laser, ultra violet or infra red beam, by a hot needle or ink jet or other means controlled according to the X and Y axes to trace out the indicia on the tubing according to the requirements.

An embodiment of this invention will now be described, by way of example only, with reference to the accompanying drawings.

DETAILED DESCRIPTION OF THE PREFERRED EMBODIMENT

Figure 1:
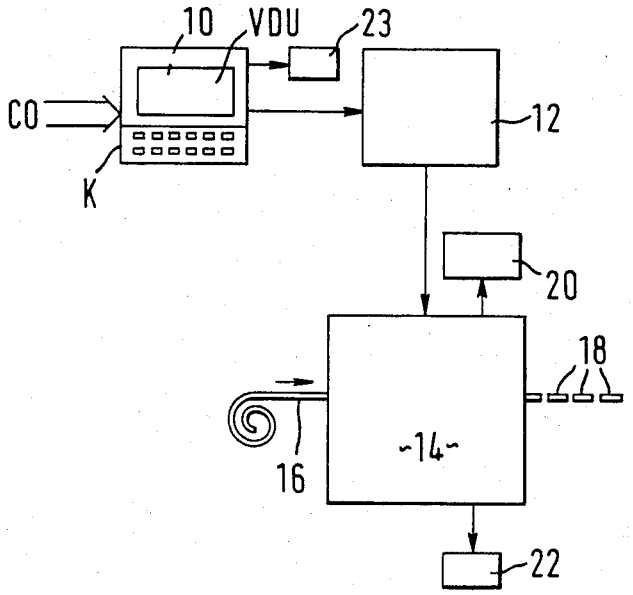
FIG. 1 is a schematic diagram of a marking apparatus in accordance with this invention.

Referring to FIG. 1, the marking apparatus comprises a microprocessor-controlled converter 10 for converting an incoming customer's order CO into machine instructions. The converter includes a keyboard K or the like for manually formulating the machine instructions from the customer's order (which itself may be communicated in any form at all, whether written or verbal), together with a visual display unit VDU for checking and correcting purposes. The converter may also include provision for receiving the incoming order over a direct data link. The converter is arranged to issue stock control data, and also to collate similar orders: for example it may be arranged to collate from different orders reqirements for sleeves of a like colour and size and to organize its machine instructions so that (within a batch of orders) these instructions relate firstly to all the requirements of one colour and size of sleeve, then to all the reqirements of a second colour and size of sleeve, and so on.

The apparatus further comprises a machine instruction or character generation unit 12 which generates the X,Y and X axis command signals (and tubing indexing command signals) from the infed machine instructions. Thus, the generated command signals not only accord with the indicia or characters required to be marked on the sleeve, but also are arranged to control the stepping forward of the tubing (and the severing means) to control the spacing between the individual characters of each sleeve and the spacing of the indicia from the ends of the sleeve. In principle, the characters which may be marked are unlimited in form and thus may be alphanumeric (of controlled size and format) or special devices, i.e., if appropriate software for these is provided within the microprocessor system of the machine unit 12.

The apparatus further comprises a marking unit 14 arranged to receive plastic tubing 16 (which may be heat-shrinkable) and transport this tubing lengthwise of itself through the unit 14 and past a marking head within the unit. The transporting mechanism of the unit 14 is arranged so that, at the position of the marking head, the tubing is under constant tension and is also flattened. The tubing may be stationary at the instant each character or index mark is written, the head including a marking pen which is driven along the X and Y axis in accordance with its command signals received from the machine instruction unit 12. Alternatively, the X-axis command signal may be directed to the transporting mechanism to effect lengthwise (forwards and reverse) movement of the tubing past the writing pen, which itself only moves along the Y-axis (transverse to the tubing) in addition to the Z-axis movements, which is in any event required for lift and positioning purposes. The marking unit further comprises a severing means for completely or partially severing the tubing as it issues from the marking unit: this severing means is synchronized to the stepping forwards of the tubing so that the severing is effected at the appropriate positions to define the individual marker sleeves 18.

A visual display unit 20 may be coupled to the marking unit for control purposes, to give a running check of the indicia currently being applied by the marking head and also to indicate when a change of tubing (e.g. colour or diameter) is required. An in-line printer 22 may also be provided to issue a print-out of the marks which have been applied and to serve as a check list against the respective customer's order. Preferably however, a printer 23 is coupled to the converter 10 to provide a hard-copy print out of the orders being input into the apparatus.

An automatic packaging unit is preferably provided to assemble and present the customer's order in either lengths of semi-severed sleeves in a required sequence and quantity, or as an assembly of separated sleeves, again in the required sequence and quantity.

Figure 2:
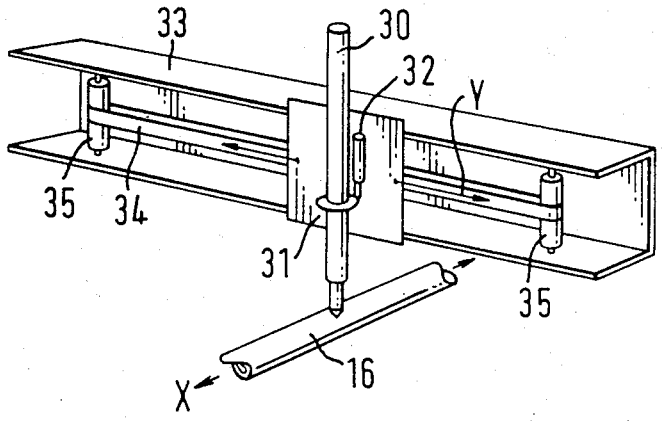
FIG. 2 is a diagrammatic view of a marking pen and portion of tubing to illustrate the principles of operation of the marking head of the apparatus.

FIG. 2 shows the principles of operation of a marking head which comprises an ink pen 30 mounted vertically above the tubing 16 and mounted for movement along the Y-axis transversely of the tubing whilst the X-axis movement, which is also necessary for each index mark or character, is produced by reciprocating the tubing 16 lengthwise of itself. The pen 30 is mounted to a carriage 31 via a solenoid 32 which serves to lift the pen tip from the tubing and place it back in contact with the tubing according to requirements. The carriage 31 is mounted to a transverse beam 33 for sliding movement along the Y-axis and is coupled to a belt 34 which is trained around rollers 35 one of which is driven by an electric motor under the control of command signals to produce the Y-axis movement.

Figure 3:
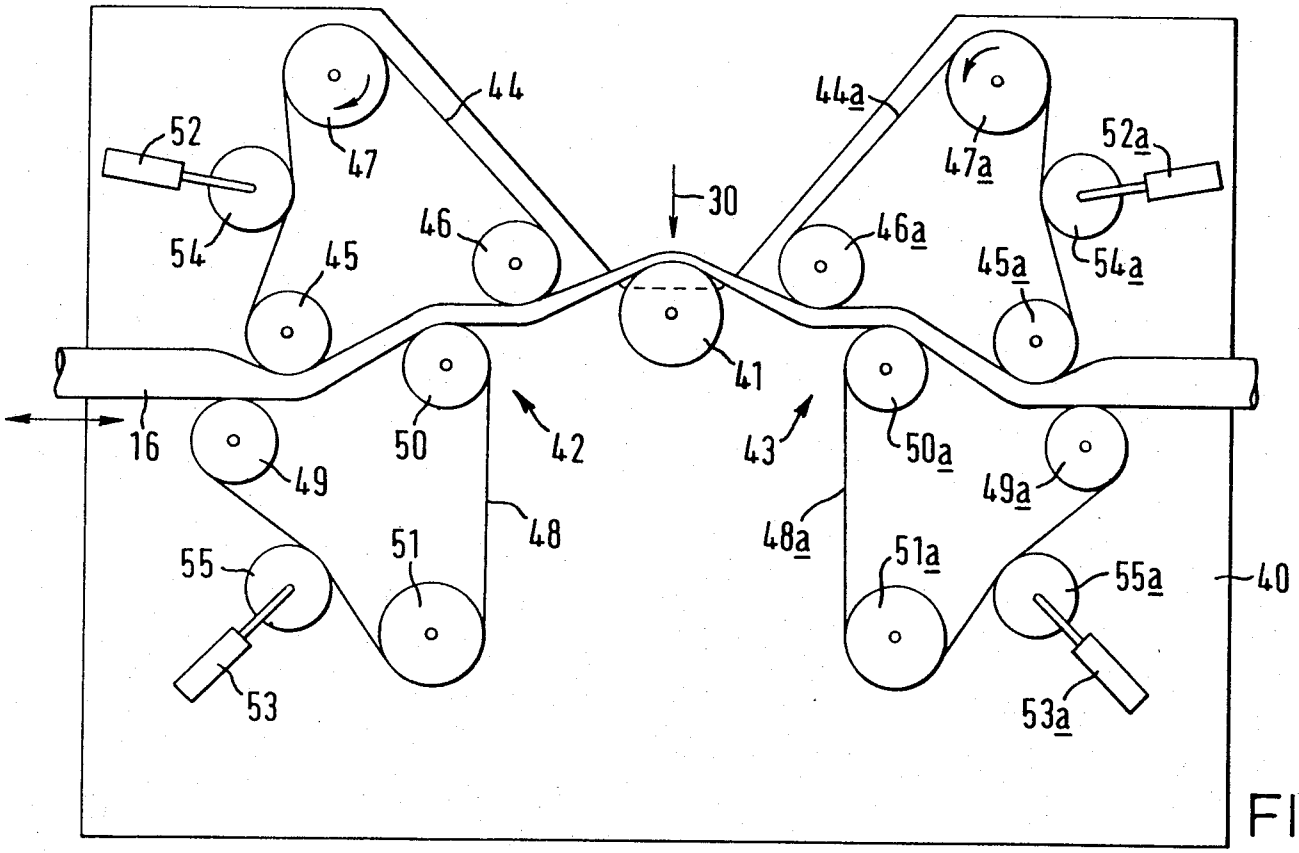
FIG. 3 is a diagrammtic view of the transporting mechanism for the tubing, seen from one side to show the transporting of the tubing.
Figure 4:
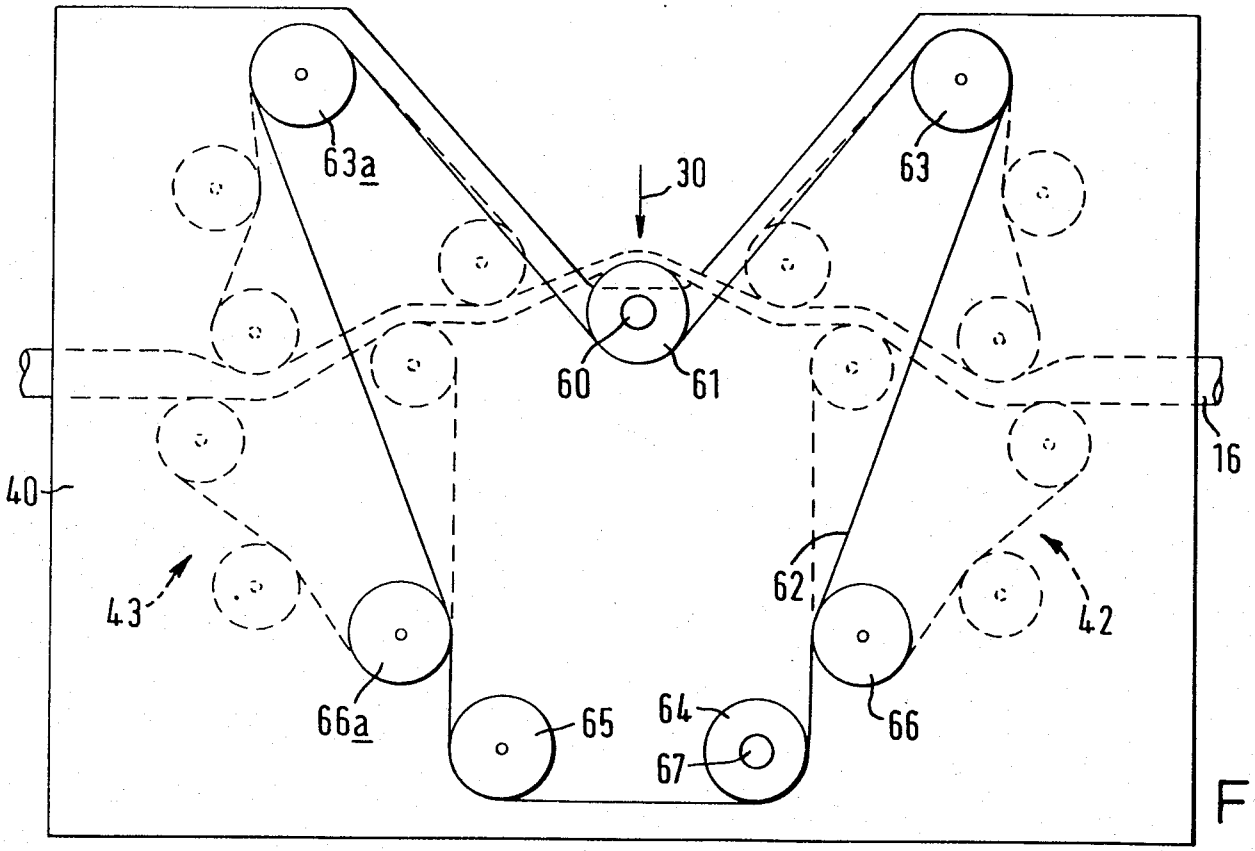
FIG. 4 is a diagrammatic view of the tubing transporting mechanism, seen from the opposite side to show the driving arrangements of the mechanism.

FIGS. 3 and 4 show the transporting mechanism for displacing the tubing 16 lengthwise of itself past the ink pen 30. The mechanism comprises a metal support plate 40 having fixed thereto shafts to which are journalled various rotary elements of the mechanism. The tubing 16 is transported across one side of plate 40, as shown in FIG. 3, and passes over a freely-rotatable roller 41 which has its axis on the vertical axis of the pen 30. Roller 41 is profiled across its rim to constrain the tubing against transverse movement. The tubing is in contact with the rim of the roller over an arc subtending an acute angle at the roller axis, and the effect of the tubing being curved around the roller whilst being maintained under lengthwise tension is that the tubing is flattened at the location of pen 30 to present a flat area of maximum width to the pen.

The transporting mechanism comprises two drawing systems for the tubing, systems 42 and 43, respectively upstream and downstream of the marking location. Each system is a mirror-image of the other about the vertical plane containing the axis of roller 41 and it is sufficient to describe in detail system 42, corresponding elements of system 43 being given like reference numerals with the suffix a. Thus, system 42 comprises a first belt 44 trained around two idling pulleys 45,46 which are adjacent and spaced apart along the tubing path, and further around a driven pulley 47 which is spaced above pulleys 45,46. System 42 further comprises a second belt 48 trained around two idling pulleys 49,50 adjacent and spaced apart along the tubing path, and further around a driven pulley 51 spaced below pulleys 45,46. Each of the belts is toothed on its inner side for meshing with teeth on the driven pulleys 47,51. The upstream one of the two upper idling pulleys 45,46 (i.e. pulley 45) lies intermediate the two lower idling pulleys 49,50 and the downstream one of idling pulleys 49,50 (i.e. pulley 50) lies intermediate the two idling pulleys 45,46. Morever, pulley 45 projects beyond the imaginary line tangential to pulleys 49,50 and pulley 50 projects beyond the imaginary line tangential to pulleys 45,46. Accordingly, the tubing is gripped between the respective lengths of belts 44,48 which extend between the two pairs of idling pulleys and is constrained to follow the variations in direction which are shown in FIG. 3. Finally, the tension in each belt is rendered adjustable by means of respective air cylinders 52,53 acting on jockey wheels 54,55 which bear against the belts between the driven pulleys and idling pulleys 45,49 respectively. The air pressure within the cylinders is preset manually and the effect of adjusting the tension in the two belts is to adjust the pinch pressure on the tubing 16.

FIG. 4 shows the drive arrangements to the driven pulleys 47,51 and **47*a*,51*a* of the two drawing systems 42 and 43. A first electric servo motor is coupled to a drive shaft 60 on the same axis as roller 41 and carrying a toothed drive pulley 61 for a belt 62 which is correspondingly toothed on both its sides. Belt 62 is trained, as shown, under drive pulley 61, then around pulleys 63,64,65 and 63*a* whilst also engaging (on its outer side) pulleys 66 and 66*a*. A second electric servo motor is coupled to a drive shaft 67 of pulley 64, and the position of pulley 65 is manually adjustable to preset the belt tension. Pulleys 63,66 and 63*a*, 66*a* are coupled via unidirectional clutches to the driven pulleys 47,51 and 47*a*,51*a* of the respective drawing systems 42 and 43**, in each case the clutch and its input and output pulleys being on a common axis.

Operation of the transporting mechanism of FIGS. 3 and 4 is as follows. In order to index the tubing 16 forwardly until an area to receive an index mark is immediately below the pen 30, the two drive motors are energized to drive pulley 61 counter-clockwise as viewed in FIG. 4. In the consequent direction of movement of the belt 62, pulleys 63 and 66 are rotated in the free-wheeling directions of their associated clutches, whilst pulleys **63*a*, 66*a* are rotated in the engaging direction of their clutches and accordingly drive is transmitted to pulleys 47*a* and 51*a* of drawing system 43. The tubing is thus pulled forwardly by system 43 against a resistance imparted by virtue of the tortuous path of the tubing through the freewheeling system 42, thus appropriately tensioning the tubing. Once the tubing has been indexed forward in this manner to its required position for marking, the command signals from the character generation unit are applied to the pen carriage drive (for the Y-axis) and to the main and secondary drive motors coupled to pulleys 61 and 64 (for the X-axis). Thus, during the character-marking, forward and backward dislacement of the tubing (for the X-axis movement) is achieved by energizing both drive motors forwards and backwards, respectively. The drive sequence for forward displacement has just been described, whilst for backward displacement the drive to pulley 64 displaces belt 62 in the opposite direction. Pulleys 63***a* and 66*a* are now driven in the free-wheeling directions of their clutches whilst pulleys 63,66 are driven in their clutch engaging directions to transmit drive accordingly to pulleys 47 and 51 of the drawing system 42. The tubing is thus pulled backwards by system 42 against a resistance imparted by virtue of the tortuous path of the tubing through the freewheeling system 43.

Figure 5:
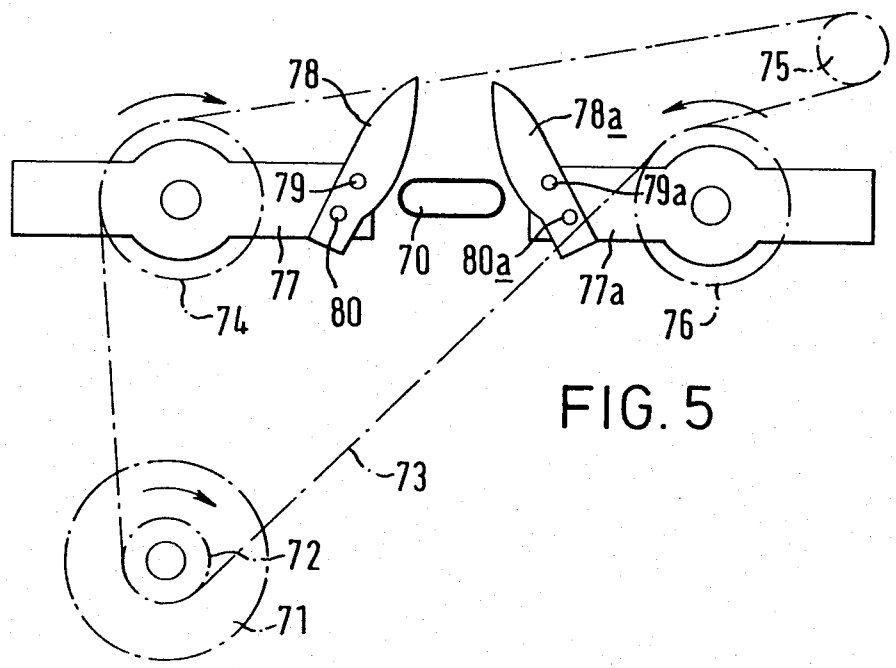
FIG. 5 is a diagrammatic view of the tube-sever or semi-sever mechanism of the apparatus.

FIG. 5 shows the mechanism for severing or semi-severing the tubing, which mechanism is located downstream of the transporting mechanism of FIGS. 3 and 4. The tubing passes to the severing or semi-severing mechanism through a guide comprising a length of tube 70 of oval cross-section, serving to partially flatten the tubing to a correspondingly shaped cross-section. An electric servo motor 71 drives a toothed pulley 72 and a belt 73 (provided with teeth on both sides) is trained around drive pulley 72, around a toothed pulley 74 for a first cutter assembly, and around an idling pulley 75: the belt further engages a toothed pulley 76 for a second cutter assembly, the arrangement being that the two cutter assemblies are rotated simultaneously in opposite senses. The two cutter assemblies comprise radiating arms 77,77*a* carried by the respective pulleys 74,76, these arms mounting cutting blades 78,78*a*. Each blade is of generally elongate shape, with one of its sides formed as a gradual convexly curved cutting edge and the blade terminating at a point at its free edge. The blades fly, when the motor is energized, in a common plane just downstream of the outlet end of the guide tube 70, which is oriented and aligned so that its oval cross-section is elongated along the plane containing the rotational axes of the two cutter assemblies.

The cutter assemblies are synchronized together so that, as shown, the blades fly simultaneously through the tubing at the two ends of its oval cross-section. The blades are inclined transversely to their support arms 77,77*a* so that the cutting edges execute a substantial movement lengthwise of themselves relative to the tubing which they sever. The angle of the blades on their support arms is adjustable to preset the extent to which they sever the tubing and the severing may be total or partial. Thus each blade is pivoted to its arm at 79,79*a* and a locking screw 80,80*a* is provided.

Figure 6:
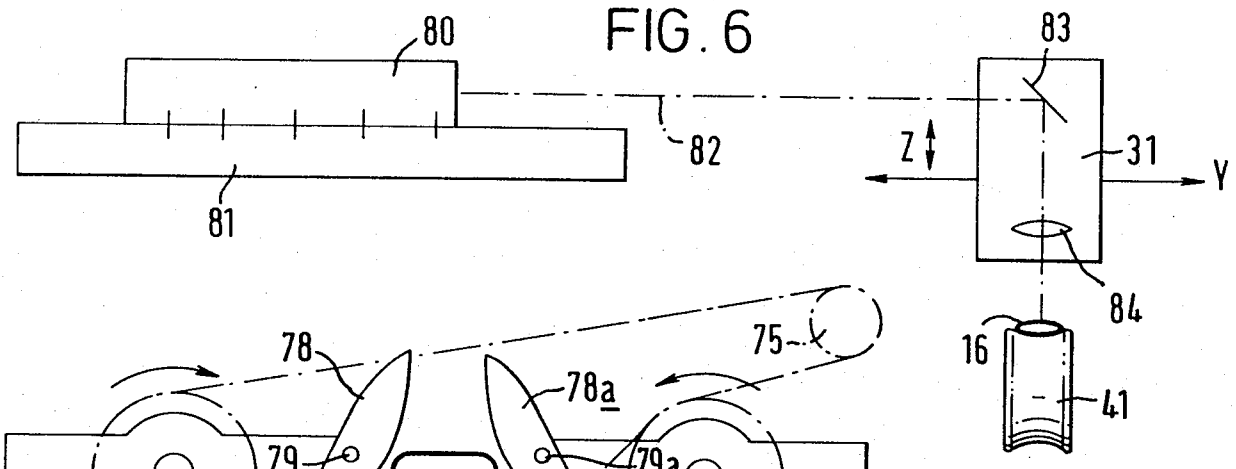
FIG. 6 is a diagram of a laser marking instrument which may be employed instead of the marking pen.

The energization of the servo motor 71 is synchronized to operate the severing mechanism when the tubing is momentarily at rest, having been indexed to its appropriate position relative to the length of the individual, marked sleeve to be severed from the tubing.

Where the marking pen is replaced by a laser, a steering mechanism for the laser may be provided as shown in FIG. 6. The tubing 16 is shown diagrammatically in its flattened condition over roller 41 at the marking location. The laser 80 is mounted to a fixed frame 81 of the apparatus, with its laser beam 82 directed parallel to the Y-axis above the tubing. The carriage 31 of FIG. 2 now mounts (in place of the pen 30 and solenoid 32) a mirror-and-lens assembly comprising firstly a planar mirror 83 oriented at 45° to the Y and Z axes in order to direct the laser beam along the Z-axis, and secondly a lens 84 to focus the beam onto the flat upper surface of the tubing. Thus, the Y-axis displacement of the point at which the laser beam strikes (and thereby marks) the tubing is achieved by Y-axis displacement of the carriage 31, as described above in connection with FIG. 2.

The apparatus which has been described with reference to FIGS. 2–6 has the advantages of a simple and reliable mechanism for producing the Y-axis displacement of the marking instrument, and a simple and reliable mechanism for producing the X-axis displacement of the tubing relative to the marking instrument, in both cases in response to the command signals for the character generation unit. Moreover, the marking instrument itself is particularly simple, whilst the character generation unit can provide for a very wide range of types and styles of characters.

I claim:

1. An apparatus for producing marker sleeves from a tubular member, said marker sleeves having a selected length and a selected indicia thereon, said apparatus comprising a backing member over which said tubular member passes as it moves in its longitudinal direction so as to temporarily become at least partially flattened as it moves thereover, a cutting means for at least partially cutting said tubular member into segments of a selected length, said segments providing said marker sleeves, a first transport means for supporting said tubular member between said backing member and said cutting means and being capable of moving said tubular member in its longitudinal direction from said backing means towards said cutting means, a marking means for applying a selected indicia on said tubular member as it moves over said backing member, said marking means being capable of applying a continuous mark on said tubular member in at least a direction transverse to its longitudinal direction, and a means for receiving orders specifying the selected indicia to be applied on the tubular member and for supplying corresponding control signals to said marking means.

2. An apparatus as defined in claim 1, including a second transport means for supporting said tubular member prior passing over said backing member and being capable of moving said tubular member in its longitudinal direction from said cutting means towards said backing member.

3. An apparatus as defined in claim 2, wherein said first transport means comprises two endless belts which have adjacent runs between which said tubular member extends, each of said two endless belts being supported by support rollers.

4. An apparatus as defined in claim 3, wherein said support rollers within said two endless belts are positioned such that the adjacent runs of said two endless belts provide a serpentine path for said tubular member.

5. An apparatus as defined in claim 3, wherein said first transport means includes tension means for adjusting the tension in each of said two endless belts.

6. An apparatus as defined in claim 2, wherein said second transport means comprises two endless belts which have adjacent runs between which said tubular member extends, each of said two endless belts being supported by support rollers.

7. An apparatus as defined in claim 6, wherein said support rollers within said two endless belts are positioned such that the adjacent runs of said two endless belts provide a serpentine path for said tubular member.

8. An apparatus as defined in claim 6, wherein said first transport means includes tension means for adjusting the tension in each of said two endless belts.

9. An apparatus as defined in claim 1, wherein said marking means comprises an ink pen, and a carriage means on which said ink pen is fixedly mounted, said carriage means being capable of moving said ink pen in a direction transverse to the longitudinal direction of said tubular member.

10. An apparatus as defined in claim 1, wherein said marking means comprises a laser capable of emitting a beam of light along an axis transverse to the longitudinal direction of said tubular member, means for deflecting said beam of light onto said tubular member, and means for reciprocating said deflecting means along said transverse axis.

11. An apparatus as defined in claim 1, wherein said cutting means comprises two pivotally-mounted blades which are located on opposite sides of the tubular member and are movable towards one another.

12. An apparatus as defined in claim 11, wherein said cutting means includes an operating means for determining the degree to which said two pivotally-mounted blades come together.

13. An apparatus as defined in claim 1, wherein said backing member comprises a roller and said tubular member wraps around a portion of the circumference of said roller.

* * * * *